United States Patent [19]

Stewart

[11] 4,212,227

[45] Jul. 15, 1980

[54] DUAL-MODE FIRING MECHANISM

[75] Inventor: Paul E. Stewart, Deerfield, Ill.

[73] Assignee: The United States of America as represented by the Secretary of the Army, Washington, D.C.

[21] Appl. No.: 621

[22] Filed: Jan. 2, 1979

[51] Int. Cl.[3] ..... F41D 11/10

[52] U.S. Cl. ..... 89/129 B

[58] Field of Search ..... 89/129 B

[56] References Cited

U.S. PATENT DOCUMENTS 3,817,148 6/1974 Schirneker ..... 89/129 B

*Primary Examiner*—Stephen C. Bentley

*Attorney, Agent, or Firm*—Nathan Edelberg; Robert P. Gibson; Max Yarmovsky

[57] ABSTRACT

A dual-mode firing mechanism for a high-rate-of-fire rifle capable of firing small arm cartridges conventionally by the application of a hammer, and inertially, bypassing the trigger mechanism, to provide sustained fire of a discrete number of cartridges in a burst. A trigger hammer fires the first round and simultaneously locks the firing pin in a firing position relative to an operating rod assembly. The operating rod assembly with the firing pin in the firing position, then cycles between a full forward or firing position and a short stroke rearward position in synchronism with fresh cartridges being inserted into the battery. The cycling continues until a last cartridge in the burst is fired. After the last round the mechanism returns to its original or non-firing position, and is ready for the next burst. The mechanism is rapid, for example, approximately 4,000 to 5,000 shots per minute can be fired in each three round burst.

7 Claims, 5 Drawing Figures

DUAL-MODE FIRING MECHANISM

GOVERNMENTAL INTEREST

The invention described herein may be manufactured, used and licensed by or for the Government for governmental purposes without payment to me of any royalty thereon.

BACKGROUND OF THE INVENTION

The invention relates generally to high-rate-of-fire rifle mechanisms, and particularly to a dual mode firing mechanism.

There is a continuing and current need to develop small arms which offer increased effectiveness over the weapons currently in the field. To attempt to maintain weapon superiority, weapon mechanisms must continually be developed which are superior in terms of effectiveness, weight, reliability, maintainability, etc. One method of increasing system effectiveness is to fire a burst of rounds at an extremely high rate of fire, so that the projectiles leave the weapon prior to any significant weapon or firer reaction. This increases the probability of obtaining a hit. In the past, however, this has only been accomplished at the cost of mechanical complexity and decreased reliability.

The present invention describes a dual-mode firing mechanism capable of firing small arm cartridges initially conventionally by application of a hammer type firing pin, subsequently by inertial firing which bypasses the trigger mechanism to provide sustained fire of a discrete number of cartridges in a burst. After a number of cartridges in the burst has been fired, the mechanism returns a firing pin to the hammer mode of firing in order to allow the firing of the next burst. The rate of fire of the burst is extremely rapid and may approach 4,000 to 4,900 shots per minute. The mechanism is easy to manufacture, light in weight, highly reliable and easy to maintain.

An object of the present invention is to provide a high rate of fire, dual mode firing mechanism, for a rifle having the ability to fire short controlled bursts at a high rate of fire with a resulting increase in the probability of obtaining a hit, and at the same time be highly reliable and easy to maintain.

SUMMARY OF THE INVENTION

According to one aspect of the invention there is provided a mechanism for firing cartridges in a burst from a battery position of a rifle having an operating rod slidably mounted in said rifle for assuming three positions—a first full forward (cocked and firing) position, a second (short, stroke rearward) position, and a third (long stroke or reload) position. The operating rod is normally in its first position. A firing pin carrier is mounted on said rod, and a firing pin is slidably mounted in the carrier between a first (or normal cocked) and a second (or firing) position. A spring normally urges the firing pin towards its first position. A firing pin locking pawl secures the pin when in its first position; and a firing pin locking plunger secures the firing pin when in its second position. A spring loaded hammer, operated when both the firing pin and operating rod are in their first positions releases the locking pawl and drives the firing pin from the first (normal) to second (forward or firing) position thereby firing the first round. The operating rod is momentarily moved to its second position and a next cartridge of the burst is moved to the battery position. The mechanism cycles between the first and second rod position until the last round is fired, then the rod momentarily moves to its third position after firing a last cartridge in the burst. A ramp releases the locking plunger when the operating rod means is moved to the third position, thereby readying the rifle for a next burst.

BRIEF DESCRIPTION OF THE DRAWINGS

FIG. 3 illustrates the mechanism in a short stroke rearward position; and FIG. 4 illustrates a full forward position with a round being fired.

DESCRIPTION OF THE PREFERRED EMBODIMENT

The dual-firing mechanism for a high rate of fire rifle is capable of firing small arms cartridges conventionally by the application of a hammer, and inertially bypassing the trigger mechanism, to provide sustained fire of a discrete number of cartridges in a burst. The number of cartridges to be fired in a burst may for example be determined by a cartridge feed mechanism which, for example, may be a cam on a revolving drum that carries the cartridges. After the number of cartridges has been fired, the dual-firing mechanism returns the firing pin to the hammer mode of firing, in order to allow the firing of the next burst.

Figure 1:
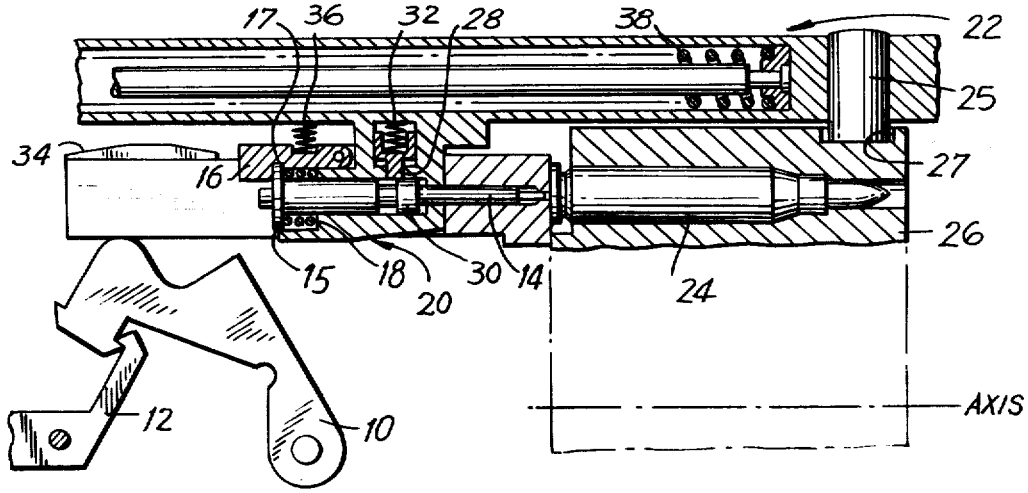
FIG. 1 is a cross sectional view of part of the mechanism of the invention illustrating the mechanism ready to fire a first shot.

FIG. 1 is a cross-sectional view of part of the mechanism of the invention illustrating the mechanism ready to fire the first shot. A hammer 10 is restrained by a trigger sear 12. A firing pin 14 is locked in a rearward position by a firing locking pawl 16. A firing pin rim in the shape of an annular collar 15 fits into a groove 17 in the pawl 16. A firing pin spring 18 urges firing pin 14 to a rearward position in which it is locked by the pawl 16. The firing pin 14, pawl 16, spring 18, and certain other members associated with the firing pin 14 (described below), are mounted on a firing pin carrier 20.

Figure 2:
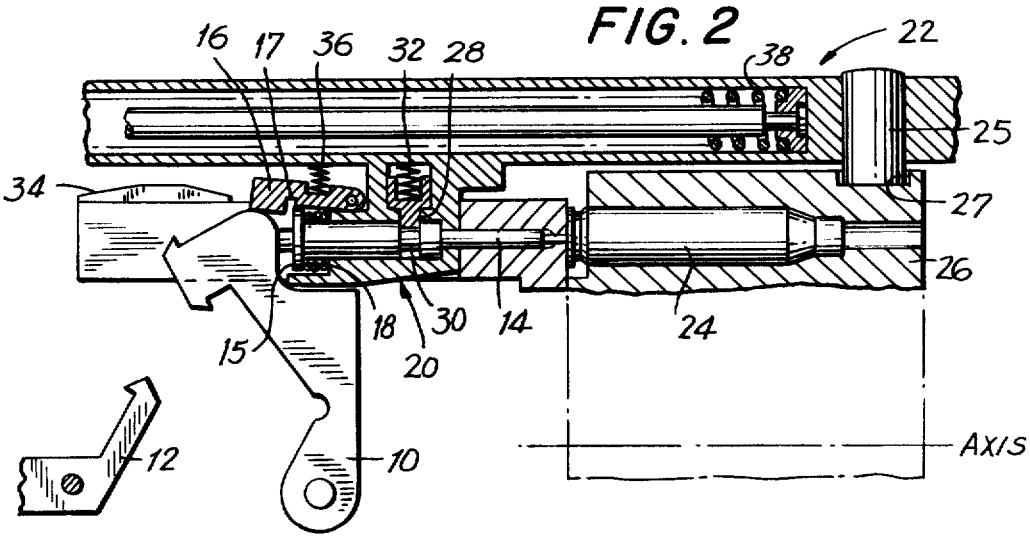
FIG. 2 is a cross sectional view similar to FIG. 1 showing the mechanism as the first round is fired.

The firing pin 14 may slidably move in the carrier 20, between a first position shown in FIG. 1 and a second or firing position, slightly forward as shown in FIG. 2. The travel of firing pin 14 from the first to the second position is about ⅛ inch. The firing pin carrier 20 is attached to an operating rod 22.

Figure 5:
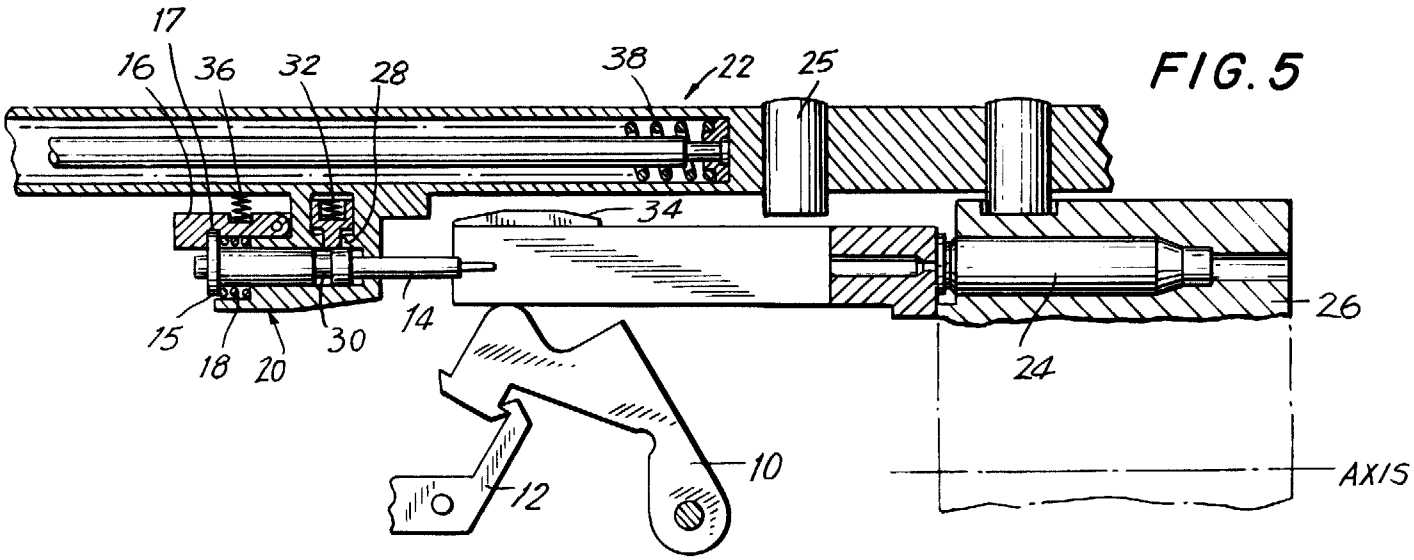
FIG. 5 is a cross sectional view of the mechanism of FIGS. 1 through 4 illustrating part of the mechanism after the last round of a burst has been fired.

Operating rod 22 is shown in FIG. 1 in its full forward position. The operating rod as shown in the subsequent figures and described below, will assume three positions during operation: full forward position, a short stroke rearward position (FIG. 3), and a long stroke rearward position (FIG. 5).

A cartridge 24 is shown in the battery position ready to be fired. Cartridges are successively fed to the battery position as for example by a revolving drum 26.

FIG. 2 illustrates the mechanism as the first round of a burst is fired. The hammer 10 has been released by the trigger sear 12. Conventional means, not shown, move the hammer from its position shown in FIG. 1 to that of FIG. 2. There are three results: (1) the hammer 10 has moved the firing pin locking pawl 16 upwards to release the firing pin 14. (2) The hammer 10 drives the pin 14 forward to fire the cartridge 24. (3) As the firing pin moves forward, a firing pin locking plunger 28 moves into an annular groove 30 (compare FIGS. 1 and 2) on firing pin 14. The firing pin locking plunger 28 is mounted on the firing pin carrier 20 and is moved into the locking position by a spring 32 when the firing pin is driven forward and locks the firing pin in its forward position.

Figure 3:
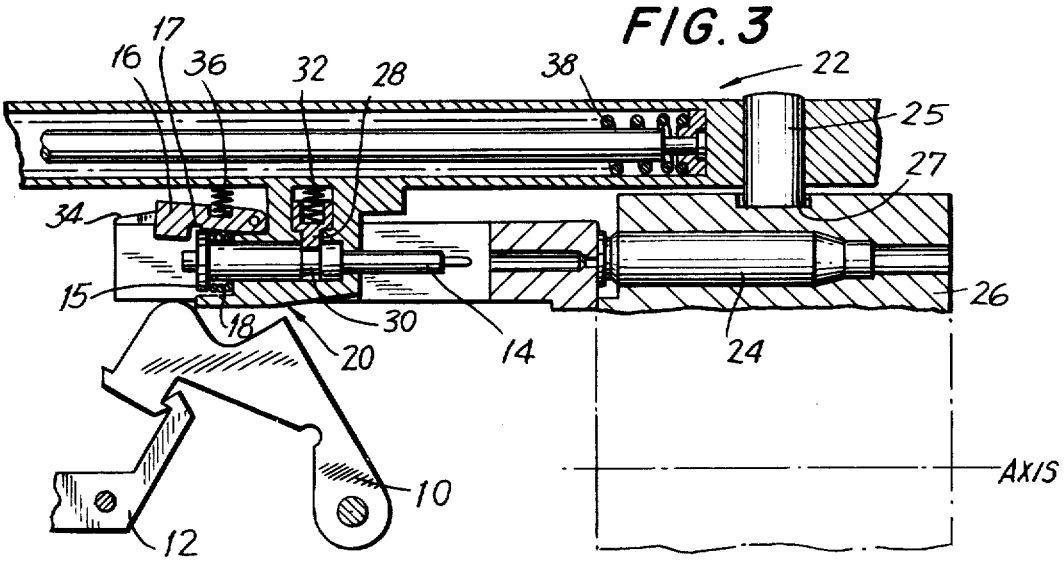
FIGS. 3 and 4 are cross sectional views similar to FIGS. 1 and 2 but illustrate the automatic firing mode.
Figure 4:
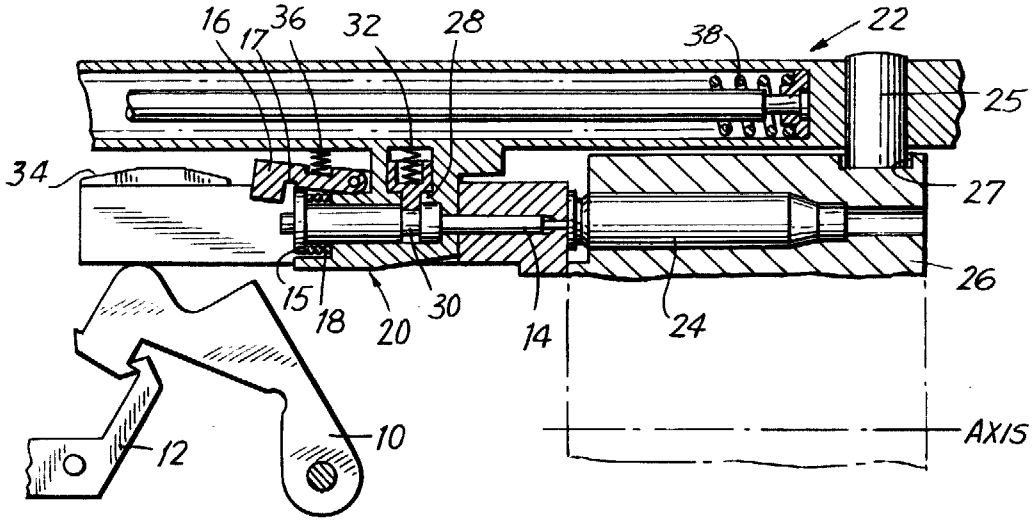

Once the first round is fired, the gun continues to fire automatically in an inertial mode as is illustrated in FIGS. 3 and 4.

FIG. 3 illustrates the position of a mechanism after firing the first shot, and the position that is momentarily assumed between shots in the burst. It may also be termed the short stroke rearward position. Powder gases from the first fired round have moved the operating rod 22 and the firing pin carrier 20 (which is fixed to the operating rod) rearwardly. The distance of travel is typically ¾ of an inch and fixed by a cam follower 25 on rod 22, in a cam track 27, on the revolving drum 26, not shown in detail. Such cams are well known and conventional, see for example U.S. Pat. Nos. 3,779,191, or 4,102,241.

Rearward movement of the firing pin carrier 20 resears the hammer 10. The spent cartridge has been moved out of battery, and a second round has moved towards the battery. The firing pin 14 it should be noted, is still in its forward position relative to the firing pin carrier 20 (it being held there by the firing pin locking plunger 28).

FIG. 4 illustrates the position of the mechanism as the second round is fired. The operating rod 22 moves to its full forward position with the second or new cartridge in battery. The firing pin 14, locked in its forward position by the firing pin locking plunger 28, contacts a primer of the second round and fires the second round. The firing pin 14 remains locked in the forward position, and the hammer remains seared by the trigger mechanism held in place by trigger sear 12. Motive force to move the operating rod 22 to the forward position is not shown in detail but, for example, may be provided by the drum, or spring loading 38 acting on the operating rod. Synchronization of the forward movement of the operating rod with the round being in the battery may be achieved by mechanical linkage through the drum. (This is conventional, and not shown or described.)

The mechanism continues to cycle between the positions illustrated in FIGS. 3 and 4 until a last round is fired. The number of cartridges to be fired in a burst is determined by the geometry of the cam on the revolving drum and the position of the drum. Such drums and cams are conventional, see for example the previously cited patents. After firing the last round, the operating rod 22 (with the firing pin carrier 20) moves to a long stroke position illustrated in FIG. 5. The long stroke position is, for example, 4½ inches to the rear (or left in the drawings) from its first or most forward position. The mechanism for permitting the operating rod to pass the long stroke position is not shown in detail and may be any convenient or conventional means, for example, a cam track on the drum 26. Motive force may be provided by a return spring or by inertia in the drum or other available or convenient source. As the firing pin carrier 20 moves rearward, it passes over ramp 34. The ramp 34 cams the firing pin locking plunger 28 upwards releasing the firing pin 14 which is driven by firing pin spring 18 rearward (to the left in the drawing) with respect to the firing pin carrier. As the firing pin 14 moves to this rearward position, it is locked in that position by the firing pin locking pawl 16 activated by the firing pin locking pawl spring 36. After taking the long stroke position, the operating rod returns energized for example by an operating rod return spring 38, to the full forward position as shown in FIG. 1. It will be appreciated that at the end of this operation the mechanism has returned to the position illustrated in FIG. 1. A new cartridge then enters the magazine and the mechanism is now ready to fire another burst in the manner just described.

What is claimed is:

1. A mechanism for firing cartridges in a burst from a battery position of a rifle comprising:

operating rod means slidably mounted in said rifle for assuming three positions—a first full forward (cocked and firing) position, a second (short stroke rearward) position, and a third (long stroke or reload) position;

means for normally urging said operating rod means to said first full forward position;

a firing pin carrier mounted on said rod;

a firing pin slidably mounted in said carrier between a normal position and a firing position;

firing pin spring means normally urging said firing pin towards said normal position;

first firing pin latching means for securing said firing pin when in a normal position;

second firing pin latching means for securing said firing pin when in said firing position;

hammer means, operable when both said firing pin and said operating rod means are in said first full forward position and said normal position respectively, and when operated for releasing said first latching means and driving said firing pin from said normal position to said second firing position;

means for momentarily moving said operating rod means to said second position after a cartridge is fired and a next cartridge of the burst is moved to said battery position;

means for momentarily moving said operating rod means to said third position after firing a last cartridge in the burst; and ramp means for releasing said second latching means when said rod means is moved to said third position.

2. Mechanism according to claim 1 further comprising trigger sear means for latching said hammer means in its seared position; and said firing pin carrier including means for moving said trigger means to its seared position when said operating rod means is moved from said first to said second position.

3. Mechanism according to claim 1 wherein said second firing pin latching means includes a groove perpendicular to the axis of said firing pin; a plunger slidably positioned into said groove; and a spring normally urging said plunger into said groove.

4. Mechanism according to claim 3 wherein said groove is an annular groove; and said normal and firing positions of said firing pin are about ⅛th of an inch apart; whereby said plunger rests on an outer periphery of said firing pin when said firing pin is in the normal position, and is then aligned with and is urged into said annular groove when said firing pin is moved to the firing position.

5. Mechanism according to claim 1 wherein said first firing pin latching means comprises a pivotally mounted pawl; and said firing pin includes a rim that is engaged by said pawl when said pin and pawl are both in the normal position.

6. A mechanism according to claim 5 wherein said rim on said firing pin is an annular collar and said pawl includes a groove to engage said rim, and said further means includes a spring for normally urging said pawl into a pivotal position where said groove engages said collar.

7. A mechanism for firing cartridges in a burst from a battery position of a rifle comprising operating rod means slidably mounted in said rifle for assuming three positions—a first full forward (cocked and firing) position, a second (short, stroke rearward) position, and a third (long stroke or reload) position;

means for normally urging said operating rod to its first position;

a firing pin carrier mounted on said operating rod means;

a firing pin slidably mounted in said carrier between a normal cocked position and firing position;

firing pin spring means normally urging said firing pin towards said first position;

first firing pin latching means securing said pin when in said normal position;

second firing pin latching means securing said firing pin when in said firing position;

hammer means, operable when both said firing pin and said operating rod means are in said first position, and when operated for releasing said first latching means and driving said firing pin from said normal to second firing position; and ramp means for releasing said second latching means when said rod means is moved to said third position.

* * * * *